US009316088B2

(12) United States Patent
Reid et al.

(10) Patent No.: US 9,316,088 B2
(45) Date of Patent: Apr. 19, 2016

(54) DOWNHOLE CONTINGENCY APPARATUS

(71) Applicant: Halliburton Manufacturing & Services Limited, Leatherhead (GB)

(72) Inventors: Michael Adam Reid, Scotlant (GB); Gary Henry Smith, Scotland (GB)

(73) Assignee: Halliburton Manufacturing & Services Limited, Leatherhead (GB)

( * ) Notice: Subject to any disclaimer, the term of this patent is extended or adjusted under 35 U.S.C. 154(b) by 287 days.

(21) Appl. No.: 13/648,564

(22) Filed: Oct. 10, 2012

(65) Prior Publication Data

US 2013/0092380 A1 Apr. 18, 2013

(30) Foreign Application Priority Data

Oct. 11, 2011 (GB) ..... 1117505.6

(51) Int. Cl.
*E21B 34/06* (2006.01)
*E21B 23/00* (2006.01)
*E21B 34/10* (2006.01)

(52) U.S. Cl.
CPC ..... *E21B 34/06* (2013.01); *E21B 23/00* (2013.01); *E21B 34/066* (2013.01); *E21B 34/10* (2013.01)

(58) Field of Classification Search
CPC ..... E21B 34/00; E21B 34/06; E21B 34/102
USPC ..... 166/316
See application file for complete search history.

(56) References Cited

U.S. PATENT DOCUMENTS

| | | | |
|---|---|---|---|
| 1,448,818 | A | 3/1923 | Stokes |
| 2,042,817 | A | 6/1936 | Wilcox |
| 2,599,774 | A | 6/1952 | Ohls |
| 2,710,655 | A | 6/1955 | Haskell |
| 2,883,146 | A | 4/1959 | Knox |
| 2,916,254 | A | 12/1959 | Wendell |
| 3,072,379 | A | 1/1963 | Hamer |
| 3,241,808 | A | 3/1966 | Allen |
| 3,395,758 | A | 8/1968 | Kelly et al. |
| 3,424,190 | A | 1/1969 | Wolfensperger |
| 3,472,484 | A | 10/1969 | Parker |
| 3,581,820 | A | 6/1971 | Burns |

(Continued)

FOREIGN PATENT DOCUMENTS

| | | |
|---|---|---|
| CA | 2485810 | 4/2005 |
| EP | 0427371 | 5/1991 |

(Continued)

OTHER PUBLICATIONS

UK Intellectual Property Office, Search Report of UK Patent Application No. GB 1117505.6 (foreign priority application), Jan. 19, 2012. Search Report issued in connection with UK priority patent application prior to filing instant U.S. patent application.

(Continued)

*Primary Examiner* — Brad Harcourt
(74) *Attorney, Agent, or Firm* — Alan Bryson; Fish & Richardson P.C.

(57) ABSTRACT

A tubing mounted completion assembly that includes at least one downhole valve assembly and at least one contingency device. The contingency device or devices can be associated with and can be separate from the downhole valve assembly. The contingency device or devices can be adapted to operate upon failure of operation of the downhole valve assembly.

24 Claims, 7 Drawing Sheets

(56) References Cited

U.S. PATENT DOCUMENTS

| | | | | |
|---|---|---|---|---|
| 3,815,676 | A | 6/1974 | Read | |
| 3,960,363 | A | 6/1976 | Domyan | |
| 3,061,267 | A | 10/1976 | Hamer | |
| 3,993,130 | A | 11/1976 | Papp | |
| 4,022,426 | A | 5/1977 | Read | |
| 4,022,427 | A | 5/1977 | Read | |
| 4,029,292 | A | 6/1977 | Kramer et al. | |
| 4,080,982 | A | 3/1978 | Maezawa | |
| 4,281,715 | A | 8/1981 | Farley | |
| 4,315,542 | A | 2/1982 | Dockins, Jr. | |
| 4,355,685 | A | 10/1982 | Beck | |
| 4,406,335 | A | 9/1983 | Koot et al. | |
| 4,421,174 | A | 12/1983 | McStravick et al. | |
| 4,506,693 | A | 3/1985 | Acker | |
| 4,519,579 | A | 5/1985 | Brestel et al. | |
| 4,606,368 | A | 8/1986 | McCafferty | |
| 4,616,857 | A | 10/1986 | Woodman et al. | |
| 4,700,924 | A | 10/1987 | Nelson et al. | |
| 4,709,762 | A | 12/1987 | Pringle et al. | |
| 4,776,395 | A | 10/1988 | Baker et al. | |
| 4,782,896 | A | 11/1988 | Witten | |
| 4,796,705 | A | 1/1989 | Carmody et al. | |
| 4,815,701 | A | 3/1989 | Stone | |
| 4,903,775 | A | 2/1990 | Manke | |
| 4,921,044 | A | 5/1990 | Cooksey | |
| 4,949,788 | A | 8/1990 | Szarka et al. | |
| 4,991,654 | A | 2/1991 | Brandell et al. | |
| 5,101,907 | A | 4/1992 | Schultz et al. | |
| 5,263,683 | A | 11/1993 | Wong | |
| 5,316,084 | A | 5/1994 | Murray et al. | |
| 5,529,126 | A | 6/1996 | Edwards | |
| 5,547,029 | A | 8/1996 | Rubbo et al. | |
| 5,615,548 | A | 4/1997 | Winfree et al. | |
| 5,865,246 | A | 2/1999 | Brown | |
| 5,875,852 | A | 3/1999 | Floyd et al. | |
| 5,911,285 | A | 6/1999 | Stewart et al. | |
| 6,003,834 | A | 12/1999 | Read | |
| 6,041,864 | A | 3/2000 | Patel et al. | |
| 6,044,908 | A | 4/2000 | Wyatt | |
| 6,145,595 | A | 11/2000 | Burris | |
| 6,276,458 | B1 | 8/2001 | Malone et al. | |
| 6,308,783 | B2 | 10/2001 | Pringle et al. | |
| 6,315,047 | B1 | 11/2001 | Deaton et al. | |
| 6,450,255 | B2 | 9/2002 | Carmody et al. | |
| 6,550,541 | B2 | 4/2003 | Patel | |
| 6,575,237 | B2 | 6/2003 | Purkis et al. | |
| 6,668,936 | B2 | 12/2003 | Williamson et al. | |
| 6,684,950 | B2 | 2/2004 | Patel | |
| 6,715,558 | B2 | 4/2004 | Williamson | |
| 6,776,240 | B2 | 8/2004 | Kenison et al. | |
| 6,782,952 | B2 | 8/2004 | Garay et al. | |
| 6,860,330 | B2 | 3/2005 | Jackson | |
| 6,880,638 | B2 | 4/2005 | Haughom et al. | |
| 6,951,331 | B2 | 10/2005 | Haughom et al. | |
| 6,974,121 | B2 | 12/2005 | Koester et al. | |
| 7,204,315 | B2 | 4/2007 | Pia | |
| 7,258,323 | B2 | 8/2007 | Dwivedi | |
| 7,306,043 | B2 | 12/2007 | Toekje et al. | |
| 7,597,150 | B2 | 10/2009 | Clem | |
| 7,614,452 | B2 | 11/2009 | Kenison et al. | |
| 7,690,432 | B2 | 4/2010 | Noske et al. | |
| 8,316,953 | B2 | 11/2012 | Reid | |
| 8,602,112 | B2 | 12/2013 | Reid | |
| 2002/0046845 | A1 | 4/2002 | Rayssiguier et al. | |
| 2002/0053438 | A1 | 5/2002 | Williamson, Jr. | |
| 2002/0066574 | A1 | 6/2002 | Leismer et al. | |
| 2003/0047702 | A1 | 3/2003 | Gunnarsson et al. | |
| 2004/0035578 | A1 | 2/2004 | Ross et al. | |
| 2004/0041120 | A1 | 3/2004 | Haughom et al. | |
| 2004/0046143 | A1 | 3/2004 | Haughom et al. | |
| 2004/0112608 | A1 | 6/2004 | Jackson | |
| 2004/0154839 | A1 | 8/2004 | McGarian et al. | |
| 2005/0087344 | A1 | 4/2005 | Toekje et al. | |
| 2005/0151107 | A1 | 7/2005 | Shu | |
| 2005/0224235 | A1* | 10/2005 | Patel | 166/386 |
| 2005/0230118 | A1 | 10/2005 | Noske et al. | |
| 2007/0102163 | A1 | 5/2007 | Heath et al. | |
| 2007/0187106 | A1 | 8/2007 | Wolters | |
| 2007/0187107 | A1 | 8/2007 | Pringle | |
| 2007/0204999 | A1 | 9/2007 | Cowie et al. | |
| 2008/0203346 | A1 | 8/2008 | Shu | |
| 2009/0050335 | A1 | 2/2009 | Mandrou | |
| 2009/0071658 | A1 | 3/2009 | Reid et al. | |
| 2009/0288838 | A1 | 11/2009 | Richards | |
| 2010/0071962 | A1 | 3/2010 | Beuershausen | |
| 2011/0000679 | A1 | 1/2011 | Joseph et al. | |
| 2011/0061875 | A1* | 3/2011 | Tips et al. | 166/373 |
| 2011/0203809 | A1 | 8/2011 | Knobloch, Jr. et al. | |
| 2012/0261137 | A1* | 10/2012 | Martinez et al. | 166/373 |
| 2012/0312547 | A1 | 12/2012 | Miller | |
| 2013/0000922 | A1 | 1/2013 | Skinner et al. | |
| 2013/0087341 | A1 | 4/2013 | Reid | |
| 2013/0087344 | A1 | 4/2013 | Reid | |
| 2013/0098624 | A1 | 4/2013 | Reid | |

FOREIGN PATENT DOCUMENTS

| | | |
|---|---|---|
| EP | 1136649 | 9/2001 |
| EP | 1241322 | 3/2002 |
| EP | 1350007 | 10/2005 |
| EP | 1350008 | 10/2005 |
| GB | 939999 | 10/1963 |
| GB | 2201979 | 9/1988 |
| GB | 2293433 | 3/1996 |
| GB | 2344152 | 5/2000 |
| GB | 2377743 | 1/2003 |
| GB | 2388854 | 11/2003 |
| GB | 2396633 | 6/2004 |
| GB | 2397316 | 7/2004 |
| GB | 2411677 | 9/2005 |
| GB | 2425585 | 11/2006 |
| GB | 2434814 | 8/2007 |
| GB | 2451288 | 1/2009 |
| GB | 2473092 | 3/2011 |
| WO | WO 99/45231 | 9/1999 |
| WO | WO01/86113 | 11/2001 |
| WO | WO03/001019 | 1/2003 |
| WO | WO2004057689 | 7/2004 |
| WO | WO2005052302 | 6/2005 |
| WO | WO2005052313 | 6/2005 |
| WO | WO 2009/033018 | 3/2009 |
| WO | WO2009132462 | 11/2009 |
| WO | WO2010129631 | 11/2010 |
| WO | WO 2011/002676 | 1/2011 |
| WO | WO2011072367 | 6/2011 |

OTHER PUBLICATIONS

Extended European Search Report, European Application No. 12185092.9, Mar. 18, 2014, 5 pages.

Extended European Search Report, European Application No. 14195113.7, Mar. 13, 2015, 5 pages.

Fisher Product Bulletin—"Type Vee-Ball Designs V150, V200 and V300", Rotary Control Valves, Apr. 2005.

PCT/GB2006/000669; International Preliminary Report dated Aug. 28, 2007.

PCT/GB2006/000669; International Search Report dated Jun. 14, 2006.

UK Intellectual Property Office, Search Report of UK Patent Application No. GB 1117502.3 (foreign priority application), Jan. 20, 2012. Search Report issued in connection with UK priority patent application prior to filing instant U.S. patent application.

UK Intellectual Property Office, Search Report of UK Patent Application No. GB 1117507.2 (foreign priority application), Jan. 20, 2012. Search Report issued in connection with UK priority patent application prior to filing instant U.S. patent application.

UK Intellectual Property Office, Search Report of UK Patent Application No. GB 1117511.4 (foreign priority application), Jan. 22, 2012. Search report issued in connection with UK priority application prior to filing instant US patent application.

UK Search Report: Appln. GB1019746.5; Date of Search: Jan. 28, 2011.

* cited by examiner

DOWNHOLE CONTINGENCY APPARATUS

CROSS REFERENCE TO RELATED APPLICATIONS

The present application claims priority to United Kingdom Patent Application No. GB1117505.6, filed Oct. 11, 2011, and titled DOWNHOLE CONTINGENCY APPARATUS, the contents of which are expressly incorporated herein by reference.

BACKGROUND OF THE INVENTION

1. Field of the invention

The present invention relates to a downhole contingency apparatus. In particular the present invention relates to a downhole apparatus that provides a contingency/back-up device in the event that a downhole valve has failed.

2. Description of the related art

Well completion involves various downhole procedures prior to allowing production fluids to flow thereby bringing the well on line. One of the downhole procedures routinely carried out during well completion is pressure testing where one downhole section of the well is isolated from another downhole section of the well by a closed valve mechanism such that the integrity of the wellbore casing/liner can be tested.

Well completion generally involves the assembly of downhole tubulars and equipment that is required to enable safe and efficient production from a well. In the following, well completion is described as being carried out in stages/sections. The integrity of each section may be tested before introducing the next section. The terms lower completion, intermediate completion and upper completion are used to describe separate completion stages that are fluidly coupled or in fluid communication with the next completion stage to allow production fluid to flow.

Lower completion refers to the portion of the well that is across the production or injection zone and which comprises perforations in the case of a cemented casing such that production flow can enter the inside of the production tubing such that production fluid can flow towards the surface.

Intermediate completion refers to the completion stage that is fluidly coupled to the lower completion and upper completion refers to the section of the well that extends from the intermediate completion to carry production fluid to the surface.

During testing of the intermediate completion stage the lower completion is isolated from the intermediate completion by a closed valve located in the intermediate completion. When the integrity of the tubing forming the intermediate completion section is confirmed the upper completion stage can be run-in.

Generally the completion stages are run-in with valves open and then the valves are subsequently closed such that the completion stages can be isolated from each other and the integrity of the production tubing and the well casing/wall can be tested.

Typically, the valves remain downhole and are opened to allow production fluids to flow. By opening the valves the flow of production fluids is not impeded.

In the event that a valve fails, for example where a valve becomes jammed and fails to open in a producing well remedial action is generally required because a failed valve effectively blocks the production path.

Remedial action often involves removing the valve. The valve may be removed by milling or drilling the valve out of the wellbore to provide a free flowing path for production fluid.

It will be appreciated that resorting to such remedial action can result in costly downtime because production from the well is stopped or delayed. The remedial action may result in damage to the well itself where milling or drilling the valve or valves from the wellbore may create perforations in the production tubing or the well casing or well lining. As a result such actions would preferably be avoided.

It is desirable to provide a downhole system such that production downtime due to a failed valve is reduced.

It is further desirable to provide an improved downhole valve assembly that helps to avoid using remedial actions such as milling or drilling to remove a failed valve from an intermediate or upper completion section of a wellbore.

It is desirable to provide a downhole valve assembly that provides a back-up system when there is a failed valve located in the wellbore.

BRIEF SUMMARY OF THE INVENTION

The present invention provides a tubing mounted completion assembly comprising at least one downhole valve assembly and at least one contingency device associated with and separate from the downhole valve assembly, wherein the contingency device is adapted to operate upon failure of the downhole valve assembly.

The tubing mounted completion assembly may comprise a contingency device adapted to actuate the downhole valve assembly upon failure. The tubing mounted completion assembly may comprise a contingency device operable to open the downhole valve assembly when it is closed due to failure to open. Alternatively, or in addition the tubing mounted completion assembly may comprise a contingency device operable to open the downhole valve assembly when it is open due to failure to close. Alternatively, or in addition the tubing mounted completion assembly may comprise a contingency device operable to control flow of production fluid around the downhole valve assembly when it is closed due to failure to open.

The tubing mounted completion assembly may comprise a plurality of contingency devices each arranged in series with the downhole valve assembly. One or more contingency devices may be arranged uphole of the downhole valve assembly. Alternatively, or in addition, one or more contingency devices may be arranged downhole of the downhole valve assembly.

Each contingency device may operate independently from other contingency devices in the tubing mounted completion assembly, where each contingency device is associated with secondary operation of the downhole valve assembly independently from the other contingency devices.

One or more of the contingency devices may be primed for operation upon removal of a downhole tool assembly, for example a stinger or washpipe or shifting tool.

In the primed state the contingency device may remain inoperable until a subsequent event takes place, for example, when fluid pressure is applied. The applied fluid pressure may be within a predetermined range such that unnecessary operation may be avoided.

Alternatively, or in addition one or more of the contingency devices may be operational upon retrieval of a downhole tool assembly, for example a stinger or washpipe or shifting tool.

A tubing mounted completion assembly according to an embodiment of the present invention may comprise at least one downhole valve assembly, at least one contingency device operable to open the downhole valve assembly when it is closed due to failure to open, a contingency device operable to close the downhole valve assembly when it is open due to failure to close and at least one contingency device adapted to control fluid flow around the downhole valve assembly when it is closed and causing an obstruction in the tubing mounted completion assembly.

BRIEF DESCRIPTION OF THE SEVERAL VIEWS OF THE DRAWINGS

Embodiments of the present invention will now be described, by way of example only, with reference to the accompanying drawings, in which.

DETAILED DESCRIPTION OF THE INVENTION

Figure 1:
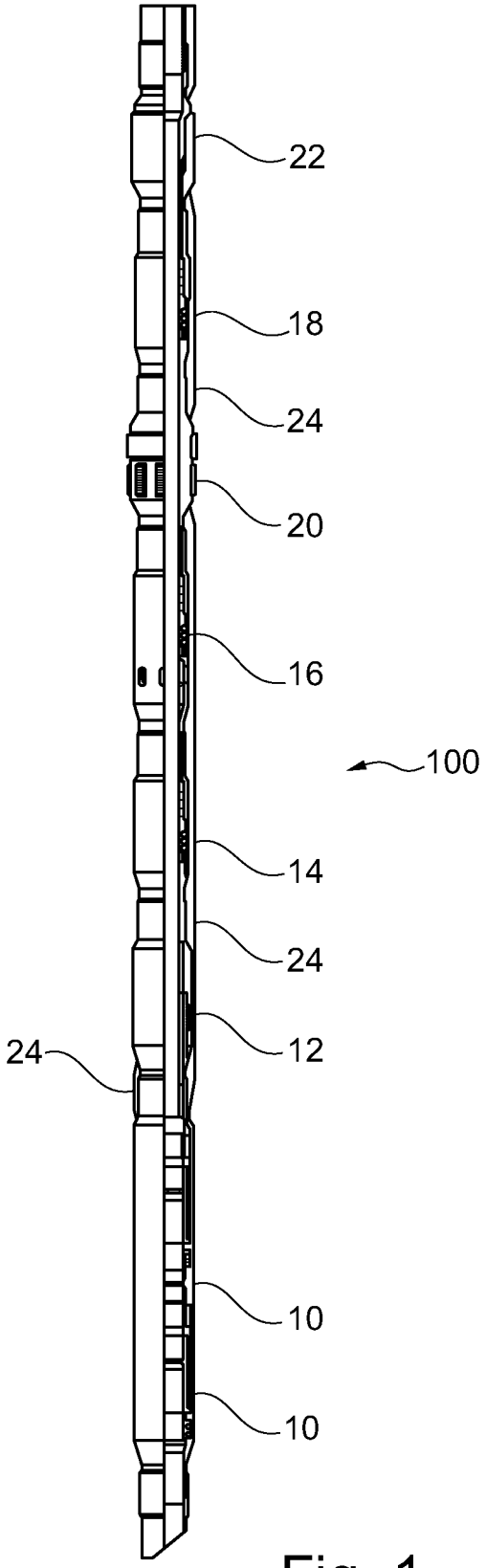
FIG. 1 is a schematic representation of a tubing mounted completion assembly in accordance with an embodiment of the present invention.

Referring to FIG. 1, a longitudinal view of a tubing mounted completion arrangement 100 is illustrated. The tubing mounted completion arrangement 100 comprises a downhole valve assembly 10 and four independently operable contingency devices 12, 14, 16, 18, a packer 20 and a hydraulic disconnect 22.

The tubing mounted completion arrangement 100 includes a packer assembly 20, which provides a seal between the outside of the production tubing 24 and the inside of a well (not illustrated).

To install the tubing mounted completion arrangement 100 in a well the downhole valve assembly 10 is run-in in an open state and is subsequently closed when it has reached its location downhole. Once closed, fluid pressure can be applied from above the downhole valve assembly 10 to check the integrity of the well. Following successful testing the downhole valve assembly 10 can be reopened such that production fluid can flow unimpeded through the downhole valve assembly 10 when the well is brought on line.

Primary actuation of the downhole valve assembly 10 can be done by suitable means, for example fluid pressure from control lines to surface (not illustrated), mechanical actuation (not illustrated) or remote electronic actuation (not illustrated). Examples of suitable valves are ball valves and flapper valves.

In a producing well the downhole valve assembly 10 must open to allow production fluid to flow through the well. In this regard, the downhole valve assembly 10, when open, and the contingency devices 12, 14, 16, 18 each comprise an axial passage such that production flow is not impeded. Therefore, production flow is only impeded when the downhole valve assembly 10 is closed.

The downhole valve assembly 10, when closed, may provide a barrier to prevent damage to a well/reservoir by preventing fluid loss during the completion phase of well construction. The downhole valve assembly 10 is therefore adapted such that it can be re-opened to allow production fluid to flow. However, in the situation where the well is to undergo workover it may be necessary to isolate the well from production fluids and as such the valve assembly 10 may need to re-close.

In the event that the downhole valve assembly 10 fails to open for production flow or fails to close for workover the contingency devices 12, 14, 16, 18 are operable to ensure efficient operation of the well even in the situation where primary actuation of the downhole valve assembly 10 has failed.

In the embodiment illustrated in FIG. 1, the contingency devices 12, 14, 16, 18 are located above the downhole valve assembly 10. However, it should be appreciated that one or more contingency devices 12, 14, 16, 18 may be located below the valve assembly.

The contingency devices 12, 14, 16, 18 each operate independently of each other and in the illustrated example comprise a mechanical closing actuator 12, a tubing opening actuator 14, an annulus bypass valve 16 and an annular closing actuator 18.

Each of the mechanical closing actuator 12, the tubing opening actuator 14 and the annular closing actuator 18 can operate as secondary, tertiary or fourth actuators because they operate subsequent to an event where the downhole valve assembly 10 has failed to open or close. Primarily, each contingency device 12, 14, 18 is operable to actuate the downhole valve 10 following failure of a primary actuator to actuate the valve 10. However, the situation may arise where the contingency devices 12, 14, 18 are operable even when a secondary actuator (not shown) has failed, for example a downhole valve assembly 10 may include a secondary actuator as part of the valve assembly. Moreover, one or more of the contingency devices 12, 14, 18 may be operable in the event that another of the contingency devices 12, 14, 18 has failed. For example, the mechanical closing actuator 12 is operable when the annular closing actuator 18 fails to close the valve 10.

The annulus bypass valve 16 is operable as a contingency device in the event that the downhole valve assembly 10 fails to open under operation of a primary, secondary or tertiary actuation, for example the tubing opening actuator 14 fails to open the valve. The bypass valve 16 operates to control or divert production fluid flow past an obstruction created by the closed downhole valve assembly 10.

For illustrative purposes, FIG. 1 illustrates an arrangement comprising two barrier valves 10. Each of the contingency devices 12, 14, 16, 18 are arranged to control actuation of the valves or to control fluid flow with respect to both valves at the same time.

The tubing mounted completion assembly 100 is self-contained as illustrated in FIG. 1, where all hydraulic lines 24 and the mechanical control system (described further below with respect to each contingency device) for the contingency devices 12, 14, 16, 18 and the control system between the contingency device and the downhole valve assembly 10 are formed as part of the tubing mounted completion assembly 100 and are contained within the well such that the contingency devices 12, 14, 16, 18 do not require control lines to surface. The location of the hydraulic control system 24 is particularly important for well workover, because when the well is being prepared for workover, production fluid is stopped and the control lines that control the downhole valve 10 are disconnected at the hydraulic disconnect 22. For example, retrieval of a downhole tool such as a stinger from the well facilitates disconnection of the hydraulic fluid control lines operating between the surface and the downhole valve assembly 10. Therefore, by including in the tubing mounted completion assembly 100 a contingency device 12, 14, 16, 18 that is mechanically or hydraulically controlled within the well it is possible following workover to reopen a closed valve using tubing pressure or applied fluid pressure.

Each of the contingency devices 12, 14, 16, 18 will be described further below with reference to FIGS. 2 to 8 in respect of how they operate and when they are operable during operation of a well/reservoir.

Figure 2:
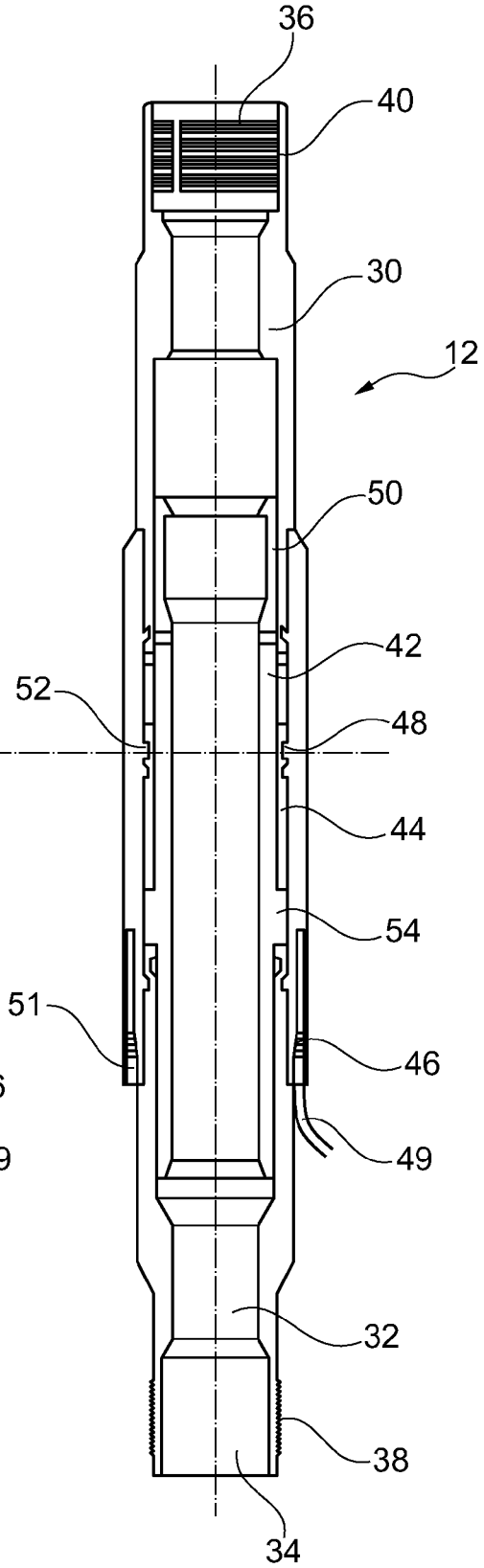
FIG. 2 is a schematic representation of a contingency device operable to actuate a downhole valve before actuation of the contingency device.

FIG. 2 illustrates a mechanical actuator 12 which provides a contingency device operable to close the downhole valve 10 when it has failed to close in preparation for well workover.

The mechanical actuator 12 comprises a tubular body 30, which includes an axial passage 32 between an inlet end 34 and an outlet end 36. The inlet 34 and the outlet 36 each comprise a threaded connection 38, 40 for attachment to the tubing mounted completion arrangement 100.

The mechanical actuator 12 comprises an operating sleeve 42 which is movable relative to the body 30. The body 30 and the sleeve 42 are assembled coaxially such that an annular reservoir 44 is defined between them. The annular reservoir 44 contains hydraulic fluid which is compressed and displaced upon displacement of the sleeve 42 due to the action of removal of a downhole tool such as a stinger or shifting tool (not illustrated).

The body 30 includes an outlet port 46 on the outside of the body 30 and an inlet port 48 open to the inside of the body 30, where the inlet port 48 is arranged to receive fluid from the annular reservoir 44 upon displacement of the sleeve 42 due to the action of removal of the stinger.

The outlet port 46 is in fluid communication with a conduit 49 that fluidly couples the annular reservoir 44 of the actuating apparatus 12 with the downhole valve assembly 10 in a region downhole of the actuating apparatus 12.

The operating sleeve 42 moves by the action of retrieval/withdrawal of a stinger (not illustrated) from the completion assembly 100.

The stinger (not illustrated) includes a mechanical coupling device such as collet fingers that are operable to engage with the profiled section 50 of the sleeve 42 such that the stinger engages with and pulls the sleeve 42 as the stinger is pulled in an uphole direction from the completion assembly 100. The sleeve 42 reaches a stop 52 inside the body 30, at which point the stinger can be disengaged from the sleeve 42.

Figure 3:
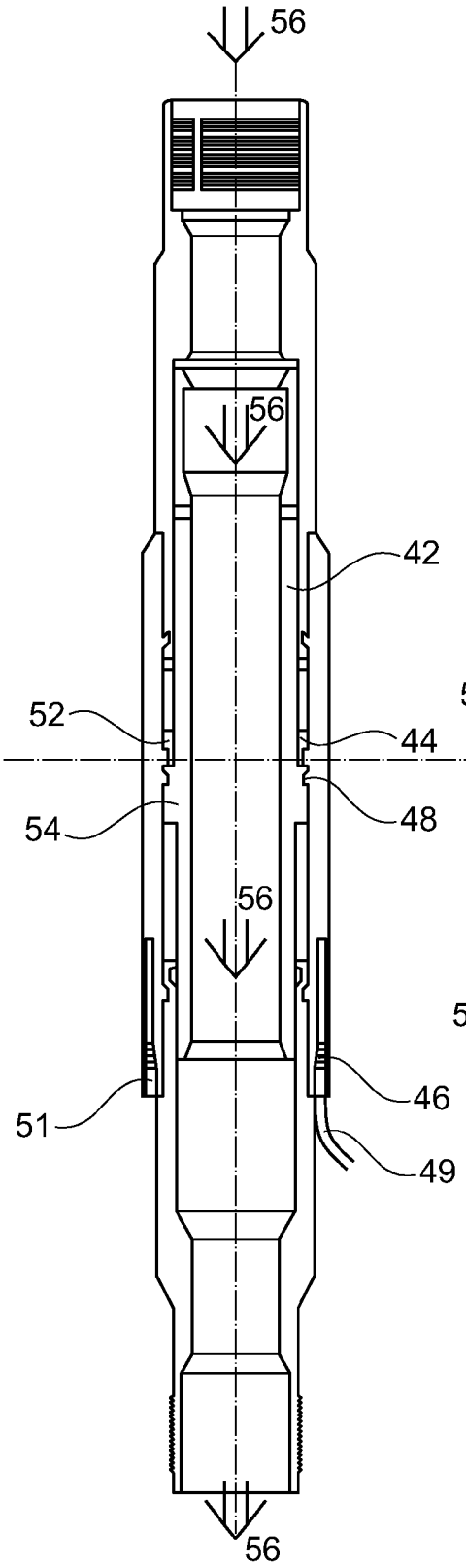
FIG. 3 is a schematic representation of the contingency device shown in FIG. 2 following actuation of the contingency device.

The sleeve 42 moves from the position illustrated in FIG. 2 to the position illustrated in FIG. 3. As the sleeve 42 moves, by action of the stinger, fluid is displaced from the annular reservoir 44 through the inlet port 48 and out of the outlet port 46 such that fluid pressure is applied downhole to close the downhole valve 10 that has failed to close under primary actuation.

The sleeve 42 incorporates a piston member 54 that acts to compress and displace the fluid such that the downhole valve 10 can be closed. It will be appreciated that the mechanical actuator 12 may be operable to open a closed valve if the actuation process is reversed.

The mechanical actuator 12 includes a return port 51. The return port 51 provides a path for fluid that is displaced from the downhole valve 10 upon actuation of the valve via the actuating apparatus 12 such that operation of the valve 10 is complete.

By using the action of retrieval of the stinger to mechanically actuate the mechanical actuator 12 to close the downhole valve assembly it is possible to check that the valve has successfully closed before fully retrieving the stinger thus disconnecting the control lines to the downhole valve assembly 10. Reliability of the valve closure may be checked by applying tubing pressure 56 from above the valve 10 and when it is established that the valve is closed and that the well is shut off the stinger can be fully withdrawn to allow the workover operation to begin.

If the annulus closing actuator 18 fails to close the valve 10 and prior to the stinger being fully retrieved the mechanical closing actuator 12 provides another contingency device that is operable to close the valve 10 to allow workover of the well.

For workover of a producing well the downhole valve 10 must be closed to shut-off production from the downhole region of the well. If primary or secondary actuation of the valve 10 fails to close the valve 10 workover of the well is delayed or prevented until production flow can be closed off.

The annular closing actuator 18 provides another contingency or back-up device to close the valve 10.

Figure 4:
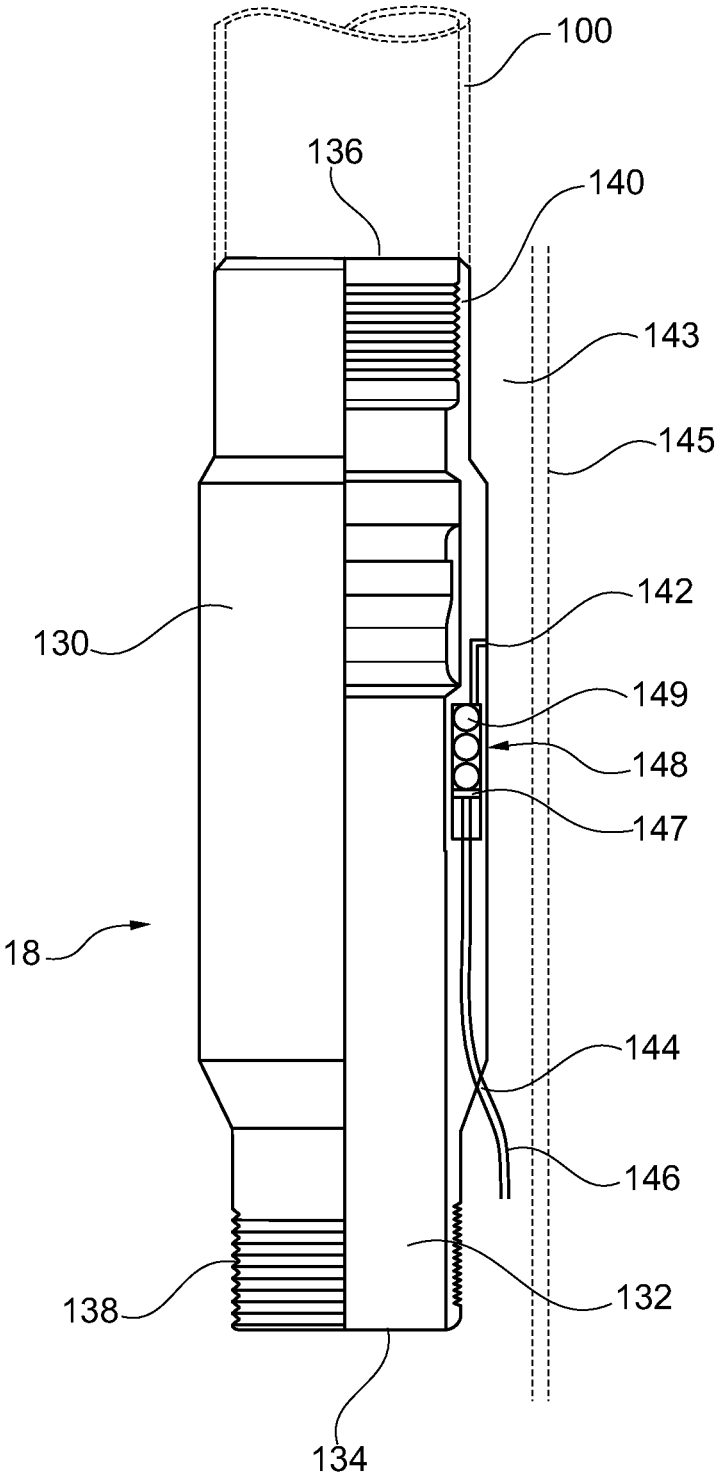
FIG. 4 is a schematic representation of a contingency device operable to actuate a downhole valve.

Referring to FIG. 4 the annular closing actuator 18 comprises a tubular body 130, which includes an axial passage 132 between an inlet end 134 and an outlet end 136. The inlet 134 and the outlet 136 each comprise a threaded connection 138, 140 for attachment to the tubing mounted completion arrangement 100. As illustrated simply in FIG. 4, the tubular body 130 also comprises an inlet port 142 and an outlet port 144 that extend in part radially through the tubular body 130.

The inlet port 142 is in fluid communication with the outside of the tubular body 130 and therefore also with the annulus region 143 of the well. The annulus region 143 of the well as illustrated in FIG. 4 is defined by the space between the outside diameter of the production tubing or the tubing mounted completion assembly 100 and the inside diameter of the well 145.

The outlet port 144 is in fluid communication with a conduit 146 that fluidly couples the annular closing actuator 18 with the downhole valve assembly 10.

The annular closing valve 18 uses fluid pressure from the annulus 143 to actuate the downhole valve 10. Therefore, in the illustrated embodiment the annulus fluid flow is provided from a region uphole of the annular closing valve 18 and uphole of the packer 20 (see FIG. 1).

The annular closing actuator 18 includes an internal actuation mechanism 148, which is illustrated simply in FIG. 4 as a piston 147 and spring 149 arrangement. A more detailed representation of the annular closing actuator 18 is illustrated in FIG. 5.

Figure 5:
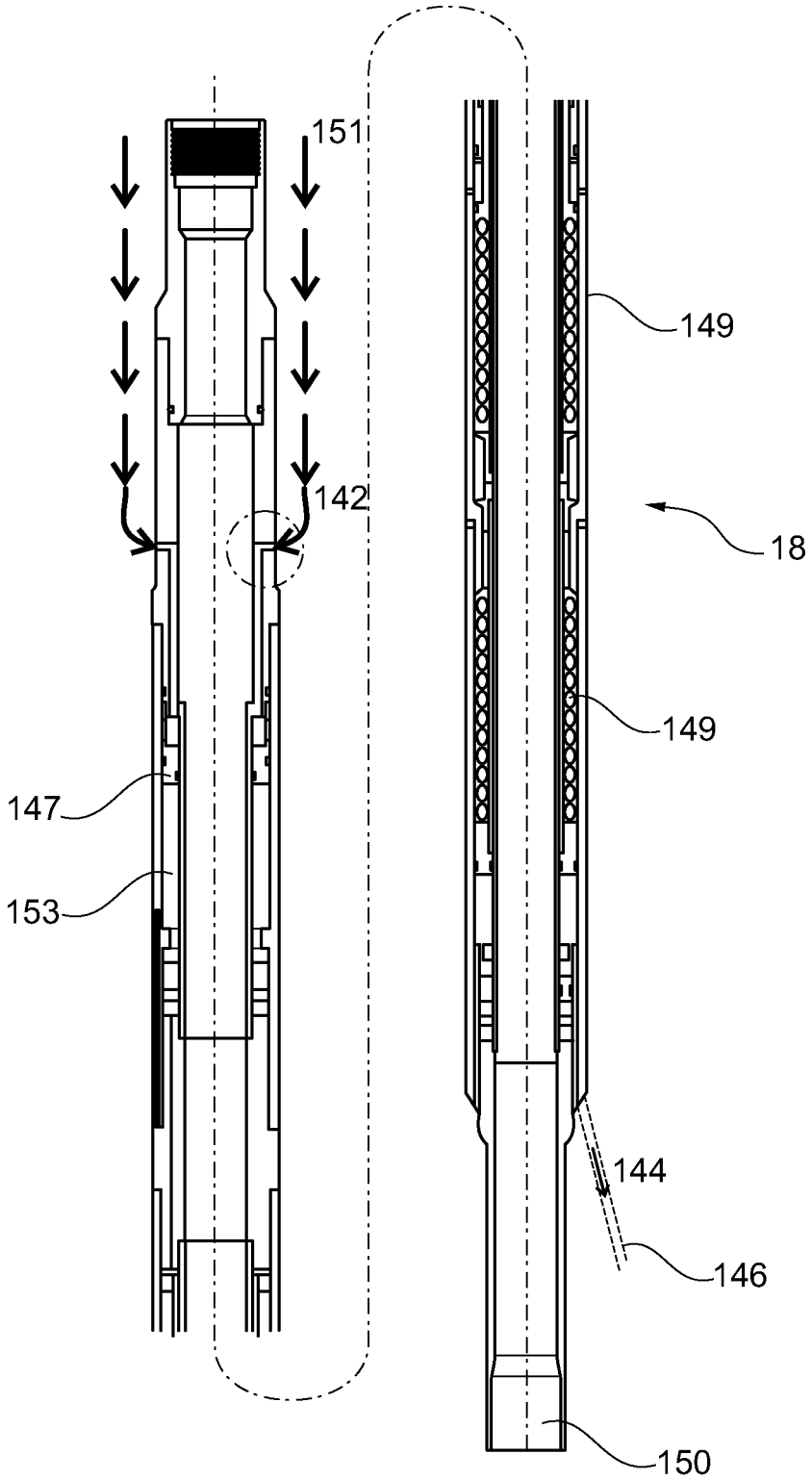
FIG. 5 is a more detailed schematic representation of the contingency device shown in FIG. 4.

FIG. 5 shows the annular closing actuator 18 and illustrates how annulus fluid flows and follows a path 151 through the annular closing actuator 18 to close the downhole valve 10.

The application of annulus fluid pressure 151 acts on the piston 147 via the inlet port 142 to move the piston 147 such that hydraulic fluid 153 contained within the annular closing actuator 18 is displaced from the outlet port 144 and to the downhole valve 10 via a conduit 146 such that the valve 10 is closed. The action of fluid pressure on the piston 147 acts to displace the fluid 153 to actuate the downhole valve 10 and whilst the fluid is being displaced. It will be appreciated that, any hydraulic pressure or locomotion force will deteriorate due to the motion of the fluid. Therefore, one or more springs 149 work with the piston 147 to assist the piston 147 such that it continues to apply a downwards force to fully displace the fluid and to ensure actuation of the valve 10.

The axial passage 150 of the annular closing actuator 18 is permanently open such that when flow of production fluid is resumed the annular closing actuator 18 does not impede flow.

Figure 6:
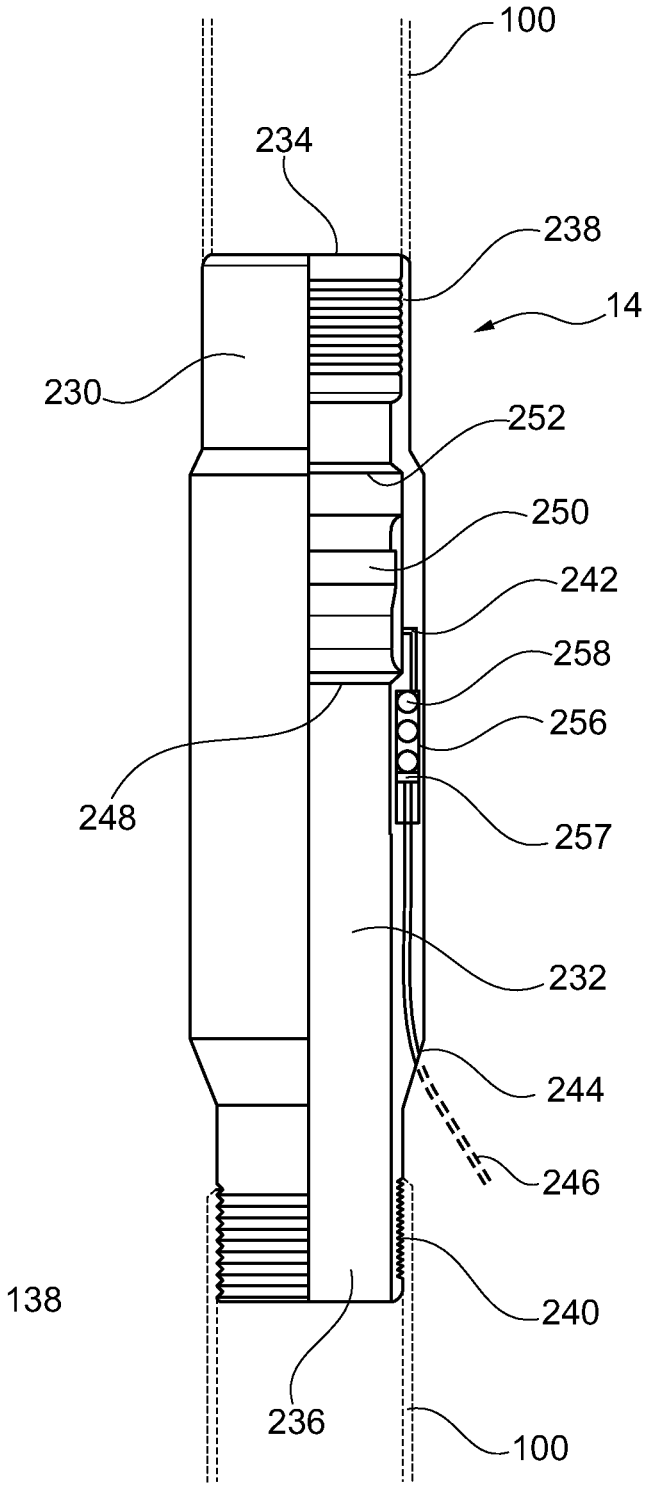
FIG. 6 is a schematic representation of a contingency device operable to actuate a downhole valve.
Figure 7:
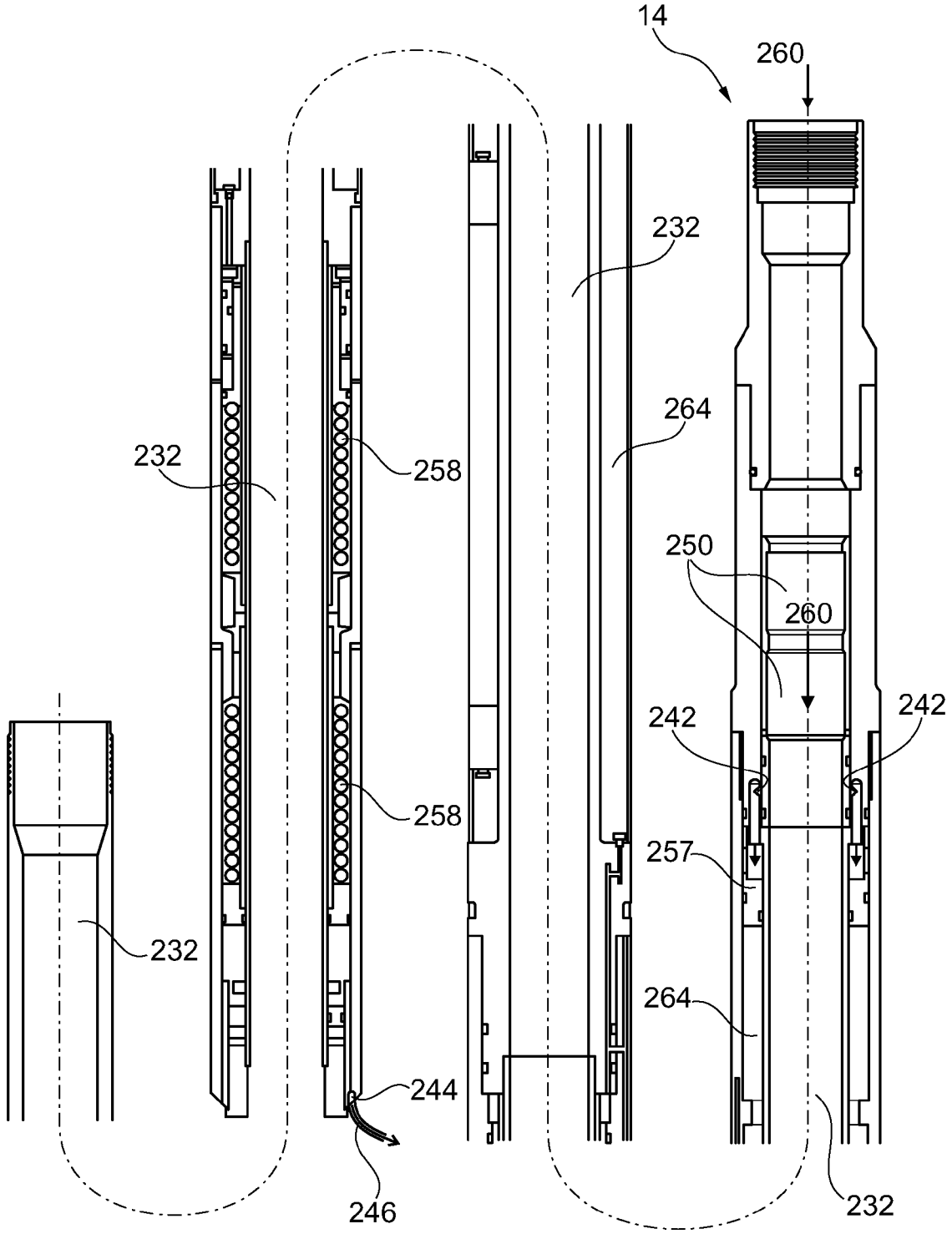
FIG. 7 is a more detailed schematic representation of the contingency device shown in FIG. 6.
Figure 8:
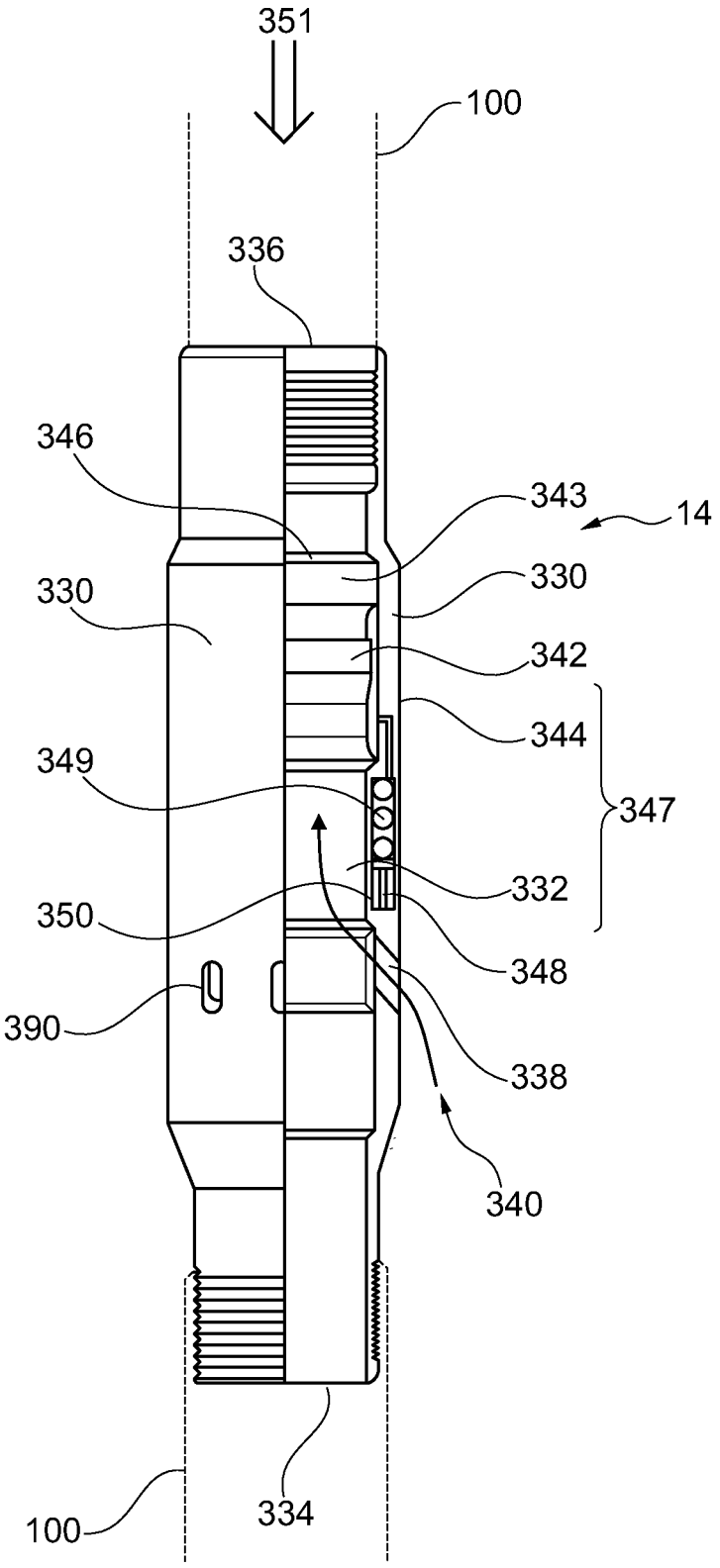
FIG. 8 is a schematic representation of a contingency device operable to control fluid flow relative to an obstruction created by a downhole valve assembly.

The description above relating to FIGS. 2 to 5 relates to the action of the contingency devices 12, 18 to close a downhole valve in preparation for workover. FIGS. 6 to 8 relate to contingency devices 14, 16 associated with a producing well where production flow may be stopped due to an obstruction in the well caused by a closed valve 10.

In FIG. 6 a tubing opening actuator 14 is illustrated, where the tubing opening actuator 14 comprises a tubular body 230, which includes an axial passage 232 between an inlet end 234 and an outlet end 236. The inlet 234 and the outlet 236 each comprise a threaded connection 238, 240 for attachment to the tubing mounted completion arrangement 100 (see FIG. 1). As illustrated simply in FIG. 6 the tubular body 230 comprises an inlet port 242 and an outlet port 244 that extend in part radially through the tubular body 230.

The inlet port 242 is in fluid communication with the axial passage 232 of the tubular body 230 and therefore also with the inside of the production tubing, in particular in the region uphole of the tubing opening actuator 14.

The outlet port 244 is in fluid communication with a conduit 246 (see FIG. 7) that fluidly couples the tubing opening actuator 14 with the downhole valve assembly 10 in a region downhole of the tubing opening actuator 14.

The tubing opening actuator 14 includes a mechanically actuated sleeve 248 that moves by the action of retrieval/withdrawal of the stinger (not illustrated) or a washpipe (not illustrated) from the completion assembly 100.

The washpipe or stinger (not illustrated) includes a mechanical coupling device such as collet fingers that are operable to engage with the profiled section 250 of the sleeve 248 such that the washpipe or stinger engages with and pulls the sleeve 248 as the washpipe or stinger is pulled from the completion assembly 100. The sleeve 248 reaches a stop 252 inside the body 230, at which point the washpipe or stinger disengages from the sleeve 248. At this point the sleeve has reached the limit of its movement and opens the inlet port 242 such that the tubing opening actuator 14 is primed and ready for operation.

The tubing opening actuator 14 comprises an internal actuation mechanism 256, which is illustrated simply in FIG. 6 as a piston 257 and spring 258 arrangement.

A more detailed representation of the tubing opening actuator 14 is provided in FIG. 7.

FIG. 7 shows the tubing opening actuator 14 and illustrates a fluid flow path 260 through the tubing opening actuator 14 that is required for the tubing opening actuator 14 to operate the downhole valve 10.

In a producing well with a downhole valve assembly 10 that fails to open, the tubing opening actuator 14 provides a secondary actuator. The tubing opening actuator 14 operates after it is primed by applying tubing pressure 260, which acts on the piston 257 via the inlet port 242 to move the piston 257 such that hydraulic fluid 264 contained within the tubing opening actuator 14 is displaced from the outlet port 244 and to the downhole valve 10 via a conduit 246 such that the valve 10 is actuated.

Fluid pressure acts on the piston 257 to displace fluid from within the assembly of the tubing opening actuator such that the displace fluid actuates the downhole valve 10. As the fluid is being displaced the hydraulic pressure or locomotion force deteriorates due to the valve opening and tubing pressure being lost. Therefore, the springs 258 operate to assist the piston 257 to continue to apply a downwards force to fully displace the fluid and to actuate the valve 10.

The axial passage 232 is permanently open such that when production fluid flow is resumed the tubing opening actuator 14 does not impede flow.

The tubing opening actuator 14 comprises a mechanically actuated sleeve 250. When each of an intermediate and an upper completion assembly are run into the wellbore a washpipe or stinger respectively is engaged with the sleeve 250 upon retrieval of the washpipe or stinger.

On completing the intermediate completion assembly and prior to installing an upper completion assembly the washpipe is removed. Upon removal of the washpipe, the washpipe engages with the sleeve 250 of the tubing opening actuator 14 and moves the sleeve 250 such that the inlet port 242 is open and ready if secondary actuation is required to open a downhole valve.

In an upper completion assembly the tubing opening actuator 14 is primed and ready for use on removal of the stinger; in preparation for workover.

Removal of the stinger disengages all control lines from the surface such that the normal operation of downhole valves etc is disabled. Following workover of the well the tubing opening actuator 14 may be used to reopen the closed valve such that a flow path for production fluid is re-established.

The tubing opening actuator 14 operates to open a closed valve 10 by application of fluid pressure 260 via the axial passage 232 and the inside of the production tubing from a region uphole of the tubing opening actuator 14 and the valve 10.

With reference to FIGS. 2 to 7 the contingency devices 12, 14, 18 that act as secondary actuators have been described above. However, in a producing well if the downhole valve assembly 10 fails to open, and remains closed regardless of attempts to open it, the valve 10 obstructs production flow. In this situation, the bypass valve assembly 16 provides a contingency device that controls or diverts production fluid around the obstruction created by the closed downhole valve 10.

Referring to FIG. 1, the annulus bypass valve 16 is located above the downhole valve assembly 10 and below the packer 20.

The annulus bypass valve 16 utilises annulus flow that flows around the obstruction created by the valve 10 and then diverts the annulus flow back into the axial passage of the tubing mounted assembly below the packer 20 and above the valve 10.

It will be appreciated that annulus flow is necessary in the region below the downhole valve assembly 10 such that a flow path around the valve 10 is created.

In one example annulus flow is created by perforations through the production tubing in the region below the downhole valve assembly 10 such that production fluid flowing in the axial passage of the production tubing below the tubing mounted completion assembly 100 flows through the perforations into the annulus. In the illustrated example (see FIG. 1), annulus flow is possible until flow is prevented by the packer assembly 20 which provides an annulus seal.

Annulus flow defines a flow path around the failed downhole valve assembly 10 and the bypass valve assembly 16 diverts the annulus flow back into the axial passage above the closed valve 10 and below the packer 20 such that production flow is not impeded by the valve 10.

In FIG. 8 a bypass valve 16 is illustrated. The bypass valve 16 comprises a tubular body 330, which includes an axial passage 332 between an inlet end 334 and an outlet end 336.

The inlet 334 and the outlet 336 each comprise a threaded connector for attachment to the tubing mounted completion arrangement 100 (see FIG. 1).

The body 330 also includes flow ports 338 extending through the body 330 in a substantially radial direction such that when the ports 338 are open fluid can flow from outside the bypass valve 16 (the annulus) to inside the bypass valve 16 (the axial passage 332) as indicated by arrow 340.

The bypass valve assembly 16 includes a mechanically actuated sleeve 342 that moves by the action of retrieval/withdrawal of a washpipe or stinger from the completion assembly.

The washpipe or stinger (not illustrated) includes a mechanical coupling device such as collet fingers that are operable to engage with the profiled section of the sleeve 342 such that the washpipe or stinger engages with and pulls the sleeve 342 as the washpipe or stinger is pulled from the completion assembly. The sleeve 342 reaches a stop 346 inside the body 330, at which point the washpipe or stinger disengages from the sleeve 342. At the limit of its movement the sleeve 342 opens a port 344 such that the bypass valve assembly 16 is primed and ready for operation in the event that the downhole valve assembly 10 fails to open.

The bypass valve assembly 16 comprises an internal actuation mechanism 347, which includes a piston 348, a spring 349 and hydraulic fluid 350.

The bypass valve 16 can be actuated by applying downhole tubing pressure 351 which acts on the piston 348 via the port 344 such that movement of the piston 348 due to fluid pressure 351 displaces the hydraulic fluid 350 contained within the bypass valve 16 to cause a mechanism 353 to move which releases a compressed spring 349 such that the spring 349 extends to complete the movement of the sleeve 342 by mechanical force exerted by the spring 349 on the sleeve 342 such that the ports 338 open. The open ports 338 provide a flow path 340 through the bypass valve 16 and hence facilitate the diversion of fluid flow from the annulus to the axial passage 330. In the illustrated example, the flow ports 338 extend through the body 330 and are inclined generally to correspond with the direction of flow of production fluid.

In the tubing mounted completion assembly 100 illustrated in FIG. 1 the annulus bypass valve 16 is shown above the downhole valve assembly 10.

Advantageously, the tubing mounted completion assembly described above provides a system that allows production to continue without requiring remedial action such as milling or drilling to remove an obstruction created by a failed valve in a producing well and following workover.

While specific embodiments of the present invention have been described above, it will be appreciated that departures from the described embodiments may still fall within the scope of the present invention.

What is claimed is:

1. A tubing mounted completion assembly comprising:

at least one downhole valve assembly comprising a primary valve actuator, and a plurality of contingency devices associated with and separate from the downhole valve assembly, each of the plurality of contingency devices arranged in series in a tubing with the downhole valve assembly, wherein each contingency device is adapted to actuate the downhole valve assembly upon failure of the primary valve actuator to actuate the downhole valve assembly, and at least one of the plurality of contingency devices comprises a mechanically-actuated contingency device and at least one of the plurality of contingency devices comprises a hydraulically-actuated contingency device, the mechanically-actuated contingency device and the hydraulically-actuated contingency device being independently coupled to the downhole valve assembly by respective conduits containing fluid, such that actuation of either the mechanically-actuated contingency device or the hydraulically-actuated contingency device causes displacement of a sealed hydraulic fluid to actuate the downhole valve assembly.

2. The tubing mounted completion assembly according to claim 1, wherein one or more of the plurality of contingency devices is operable to open the downhole valve assembly when it is closed due to failure to open.

3. The tubing mounted completion assembly according to claim 1, wherein one or more of the plurality of contingency devices is operable to close the downhole valve assembly when it is open due to failure to close.

4. The tubing mounted completion assembly according to claim 1, further comprising a contingency device operable to control flow of production fluid around the downhole valve assembly when it is closed due to failure to open.

5. The tubing mounted completion assembly according to claim 1, wherein one or more contingency devices are arranged uphole of the downhole valve assembly.

6. The tubing mounted completion assembly according to claim 1, wherein one or more contingency devices are arranged downhole of the downhole valve assembly.

7. The tubing mounted completion assembly according to claim 1, wherein each contingency device operates independently from other contingency devices in the tubing mounted completion assembly and wherein each contingency device is associated with secondary operation of the downhole valve assembly independently from the other contingency devices.

8. The tubing mounted completion assembly according to claim 1, wherein one or more of the contingency devices is primed for operation upon removal of a downhole tool assembly.

9. The tubing mounted completion assembly according to claim 8, wherein in the primed state the contingency device remains inoperable until a subsequent event takes place uphole or downhole.

10. The tubing mounted completion assembly according to claim 9, wherein the subsequent event is applied fluid pressure from a location uphole of the downhole valve assembly.

11. The tubing mounted completion assembly according to claim 10, wherein the applied fluid pressure is within a predetermined range.

12. The tubing mounted completion assembly according to claim 1, wherein the at least one contingency device is operable to open the downhole valve assembly when it is closed due to failure to open;

the tubing mounted completion assembly further comprising a contingency device operable to close the downhole valve assembly when it is open due to failure to close, and at least one contingency device adapted to control fluid flow around the downhole valve assembly in the event it remains closed and causes an obstruction in the tubing mounted completion assembly.

13. The tubing mounted completion assembly according to claim 1, wherein the downhole valve assembly further comprises a secondary valve actuator, and the contingency device is adapted to operate upon failure of the primary valve actuator and the secondary valve actuator to actuate the downhole valve assembly.

14. The tubing mounted completion assembly according to claim 13, wherein each of the plurality of contingency devices comprises a respective axial passage in fluid communication with a bore of the downhole valve assembly.

15. A tubing mounted completion assembly comprising:

at least one downhole valve assembly, and one or more contingency devices associated with and separate from the downhole valve assembly, wherein at least one of the one or more contingency devices is adapted to operate upon failure of the downhole valve assembly, and wherein at least one of the one or more contingency devices is primed for operation upon removal of a downhole tool assembly.

16. The tubing mounted completion assembly according to claim 15, wherein the at least one contingency device is operable to open the downhole valve assembly when it is closed due to failure to open, and the at least one contingency device is operable to close the downhole valve assembly when it is open due to failure to close.

17. The tubing mounted completion assembly according to claim 15, wherein at least one of the one or more contingency devices is operable to control flow of production fluid around the downhole valve assembly when it is closed due to failure to open.

18. The tubing mounted completion assembly according to claim 15, wherein the assembly comprises a plurality of contingency devices each arranged in series with the downhole valve assembly.

19. The tubing mounted completion assembly according to claim 18, wherein the one or more contingency devices are arranged uphole of the downhole valve assembly.

20. The tubing mounted completion assembly according to claim 18, wherein each contingency device operates independently from other contingency devices in the tubing mounted completion assembly and wherein each contingency device is associated with secondary operation of the downhole valve assembly independently from the other contingency devices.

21. The tubing mounted completion assembly according to claim 15, wherein in the primed state the contingency device remains inoperable until a subsequent event takes place uphole or downhole.

22. The tubing mounted completion assembly according to claim 21, wherein the subsequent event is applied fluid pressure from a location uphole of the downhole valve assembly.

23. A tubing mounted completion assembly comprising:

at least one downhole valve assembly comprising a primary valve actuator, and a plurality of contingency devices associated with and separate from the downhole valve assembly, each of the plurality of contingency devices arranged in series in a tubing with the downhole valve assembly, wherein each contingency device is adapted to actuate the downhole valve assembly upon failure of the primary valve actuator to actuate the downhole valve assembly, and at least one of the plurality of contingency devices comprises a mechanically-actuated contingency device and at least one of the plurality of contingency devices comprises a hydraulically-actuated contingency device, the mechanically-actuated contingency device comprising:

a tubular body coupled to the tubing;

a movable operating sleeve mounted coaxially with the tubular body and defining an annular reservoir containing hydraulic fluid between the operating sleeve and the tubular body, with the annular reservoir being coupled to the conduit coupled to the downhole valve assembly;

a mechanical coupling device incorporated with the operating sleeve, and operable to engage with a downhole tool conveyed through the completion assembly, such that movement of the downhole tool through the completion assembly causes the operating sleeve to translate through the tubular body; and a piston member projecting radially into the annular reservoir, which acts to displace the hydraulic fluid to close the downhole valve assembly as the operating sleeve moves in a downhole direction through the tubular body.

24. A tubing mounted completion assembly comprising:

at least one downhole valve assembly comprising a primary valve actuator, and a plurality of contingency devices associated with and separate from the downhole valve assembly, each of the plurality of contingency devices arranged in series in a tubing with the downhole valve assembly, wherein each contingency device is adapted to actuate the downhole valve assembly upon failure of the primary valve actuator to actuate the downhole valve assembly, and at least one of the plurality of contingency devices comprises a mechanically-actuated contingency device and at least one of the plurality of contingency devices comprises a hydraulically-actuated contingency device, the hydraulically-actuated contingency device comprising:

a tubular body coupled to the tubing;

an inlet port in fluid communication with a wellbore annulus region;

an outlet port in fluid communication with the conduit coupled to the downhole valve assembly; and an internal actuation mechanism comprising a piston member situated between the inlet port and the outlet port, such that fluid pressure from the wellbore annulus region acts on the piston member to displace hydraulic fluid through the outlet port to close the downhole valve assembly.

* * * * *